United States Patent [19]

Shinoda

[11] Patent Number: 4,473,053

[45] Date of Patent: Sep. 25, 1984

[54] FUEL INJECTION PUMP CONTROL SYSTEM IN DIESEL ENGINE

[75] Inventor: Kazuo Shinoda, Aichi, Japan

[73] Assignee: Toyota Jidosha Kabushiki Kaisha, Japan

[21] Appl. No.: 430,499

[22] Filed: Sep. 30, 1982

[30] Foreign Application Priority Data

Dec. 14, 1981 [JP] Japan ..... 56-201141

[51] Int. Cl.[3] ..... F02M 59/20

[52] U.S. Cl. ..... 123/502; 123/501

[58] Field of Search ..... 123/502, 501, 357; 137/625.62

[56] References Cited

U.S. PATENT DOCUMENTS

| | | | |
|---|---|---|---|
| 3,556,150 | 1/1971 | King | 137/625.62 |
| 3,777,784 | 12/1973 | Nicholson | 137/625.62 |
| 3,983,908 | 10/1976 | Bartholomaeus | 137/625.62 |
| 4,265,272 | 5/1981 | Klimowicz et al. | 137/625.62 |
| 4,397,285 | 8/1983 | O'Neill | 123/502 |

FOREIGN PATENT DOCUMENTS

| | | | |
|---|---|---|---|
| 38529 | 4/1981 | Japan | 123/502 |
| 92329 | 7/1981 | Japan | 123/502 |
| 146024 | 11/1981 | Japan | 123/502 |
| 2069723 | 8/1981 | United Kingdom | 123/502 |

*Primary Examiner*—Magdalen Y. C. Moy

*Attorney, Agent, or Firm*—Finnegan, Henderson, Farabow, Garrett & Dunner

[57] ABSTRACT

Pressure chambers are provided at opposite sides of a piston for moving a roller shaft of a timer, fuel is selectively introduced into the respective pressure chambers by a control valve or a solenoid valve, and surplus fuels in the respective pressure chambers are discharged in accordance with a movement value of the piston, so that an injection time can be controlled without being affected by fuel pressure.

4 Claims, 11 Drawing Figures

FUEL INJECTION PUMP CONTROL SYSTEM IN DIESEL ENGINE

BACKGROUND OF THE INVENTION

1. Field of the Invention

This invention relates to fuel injection pump control systems in diesel engines, and more particularly to a fuel injection pump control system in a diesel engine, suitable for electronically controlling fuel injection time.

2. Description of the Prior Art

Heretofore, in a known fuel injection system in which fuel injection time is electronically controlled, fuel injection time is controlled by an actuator displaced by the pressure of fuel from a feed pump and the fuel pressure is regulated by means of a solenoid valve.

In the arrangement of the system of the type described, the actuator is further displaced by the pressure received from a fuel pump, and the displacement of the actuator is not determined solely in response to a control signal applied to the solenoid valve. Thus, the dispersion of the fuel injection time varies in accordance with the variation in fuel pressure and the like. To obviate these problems, there is provided a sensor for measuring the displacement of the actuator, and a signal emitted from this sensor is fed back to an electronic circuit, whereby the displacement of the actuator controls the fuel injection time.

FIG. 1 is a sectional view showing the conventional fuel injection time regulating mechanism in a fuel injection pump. The fuel injection pump includes a fuel flow rate regulating mechanism by a spill position adjustment in addition to the injection time regulating mechanism shown in the drawing, however, this portion does not relate to the present invention, so that illustration and description thereof will be omitted.

A cam shaft 22 is connected to a drive shaft 20 through a coupling 21. When the cam shaft 22 is driven by the drive shaft 20, a cam 23 rotates. The cam 23 is provided thereon with corners, and when one of these corners abuts against a roller 24, the cam shaft 22 is pushed to the right in the drawing. The right end portions of the cam shaft 22 has a plunger 25 of an injection pump, to which is fed fuel under high pressure. The timing at which the fuel fed to the plunger 25 is blown out to the outside can be determined by changing the abutted position of one of the corners of the cam 23 against the roller 24. Description will be given of the manner of determining this injection timing with reference to FIG. 2.

FIG. 2 is a sectional view of FIG. 1 showing the conventional timing mechanism. The roller 24 is affixed to a portion of a ring 27 through a roller shaft 26, and the ring 27 is supported by a portion of the main body of the pump in a condition where the ring 27 is rotatable through an angle of small degrees to the right and left from the axial line of the drive shaft 20. The forward end portion of the roller shaft 26 is rotatably engaged with a timer cylinder 29 and a plunger 30 through a ball 28. The plunger 30 is determined in its position by a balance of power in a timer pressure chamber 31. In addition, a rod 32 is connected to an end portion of the plunger 30 opposite to the pressure chamber 31, and further, to a core 34 combined with a displacement meter coil 33 through rod 32 to constitute a variable inductance type displacement meter. The rod 32 is coupled thereonto with a spring 35 for rendering a biasing force against the pressure from the pressure chamber 31. In addition, a discharge port 36 is provided for rendering the waste pressure from the plunger 30 to the intake side of the pump 37, and a port 38 is provided for taking fuel into the timer cylinder 31.

FIG. 3 shows the fuel pressure system and the electric signal system under the conventional fuel injection timing control. The fuel pressure-fed from the pump 37 is fed to a high pressure pump through a discharge piping 50, and the surplus fuel in the high pressure pump is returned to an intake piping 51. Furthermore, part of the fuel in the discharge piping 50 is diverted to branch piping 53 and applied to pressure chamber 31 of the timer through a stationary throttle 54. Part of the fuel, which has passed through the fixed throttle 54 is returned to the intake piping 51 through a solenoid valve 55. The pressure in the pressure chamber 31 of the timer is produced by the stationary throttle 54 and the solenoid valve 55, and a fuel injection time is determined by a position where the pressure is balanced with the spring 35.

The solenoid valve 55 is driven by an amplifier 56, and an output signal from a comparator 58, comparing a fuel time command signal Sj with an output from a measurement signal converter 57, is used as a control command to the amplifier 56. The measurement signal converter 57 is used for wave form converting the output signal from the variable inductance type displacement meter 33.

The wave form of the signal emitted from the amplifier 56 is a rectangular wave having a cycle F and an ON-time P as shown in FIG. 4. The average value of the fuel flow rate passing through the solenoid valve 55 is determined by a duty ratio P/F of the rectangular wave. The cycle F is normally selected to be a constant value.

FIG. 5 is a characteristic diagram showing the relationship between the duty ratio P/F and the fuel injection time, in which the ON-time P is varied so as to change the duty ratio, so that the fuel injection time can be controlled. However, as apparent from the drawing, the fuel injection time is greatly influenced by the feed pressure of the pump 37. In order to minimize this change, the displacement meter 33 is provided, and an output therefrom is made to be a feedback signal.

As described above, heretofore, there have been disadvantages in that the actuator is further displaced by the pressure received from the fuel pump, and the displacement of the actuator is not determined solely by the control signal applied to the solenoid valve. Thus, the dispersion of the fuel injection time varies in accordance with the variation in fuel pressure. In order to compensate for this disadvantage, a sensor for measuring the displacement of the actuator and a signal processing circuit are provided to constitute a feedback system, which, however, has presented the disadvantage that construction becomes complicated, the cost of product is increased and the reliability is lowered.

SUMMARY OF THE INVENTION

The present invention has as its object the provision of a fuel injection pump control system in a diesel engine capable of accurately controlling the fuel injection time depending only on a fuel injection time control command.

According to the present invention, a control valve having a flapper valve or a solenoid valve, each of which is controlled by an electronic circuit, drives a piston for moving a roller shaft of a timer, and the fuel flow rate discharged from pressure chambers provided at opposite sides of a cylinder is regulated by a slit portion or a valve mechanism, each of which is varied in opening area in accordance with the movement of the piston.

DETAILED DESCRIPTION OF THE INVENTION

Figure 6:
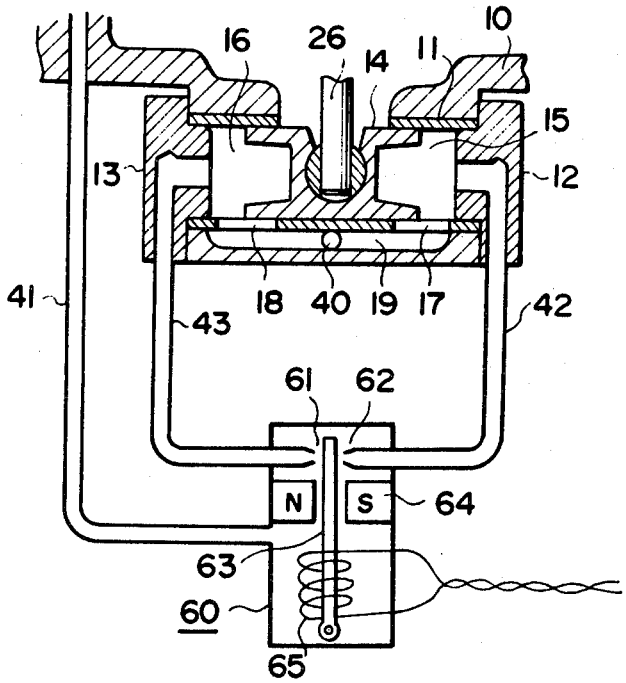
FIG. 6 is a sectional view showing the essential portions of one embodiment of the present invention.

FIG. 6 is a sectional view showing the essential portions of one embodiment of the present invention. In FIG. 6, only the timer portion is shown with other portions being omitted. A cylinder 11 is mounted in a pump body 10, and the cylinder 11 is provided at opposite sides thereof with cylinder heads 12 and 13 each having a flow path. A piston 14 engaged with a roller shaft 26 is mounted in the cylinder 11, and further, pressure chambers 15 and 16 are formed between the cylinder heads 12, 13 and the piston 14, respectively. A cylinder wall defining the pressure chambers 15 and 16 is provided therein with slits 17 and 18, whose opening areas are varied in accordance with the movement of the piston 14. The slits 17 and 18 are communicated with each other through a bypass passage 19, which is further communicated with an inlet side of the pump 37 through a discharge port 40.

The piston 14 is driven by a control valve 60 controlled by a computer or the like. The control valve 60 allots the fuel taken in through a pipe 41 to a pipe 42 or 43 so as to render a required pressure to the piston 14. This control valve 60 is constituted by flapper valves 61, 62, and armature 63, a magnet 64 and a coil 65. The flapper valves 61 and 62 are opened or closed by the armature 63 controlled by the energized condition of the coil 65. The armature 63 is normally attracted to one of the flapper valves 61 and 62, and, when the coil 65 is energized, the armature 63 is attracted to the other flapper valve. In consequence, each time the coil 65 is ON-OFF operated, fuel for control is fed to the pressure chambers 15 and 16 alternately from the flapper valve 61 or 62, whereby the piston 14 moves from the chamber of high pressure to the chamber of low pressure. Surplus fuel in the pressure chamber, into which the piston 14 has moved, is pushed out into the bypass passage 19 through the slit (17 or 18) and further sent to the discharge port 40. The amount of fuel pushed out of the slit portion is decreased because the opening area of the slit portion is reduced as the piston 14 moves.

Figure 7:
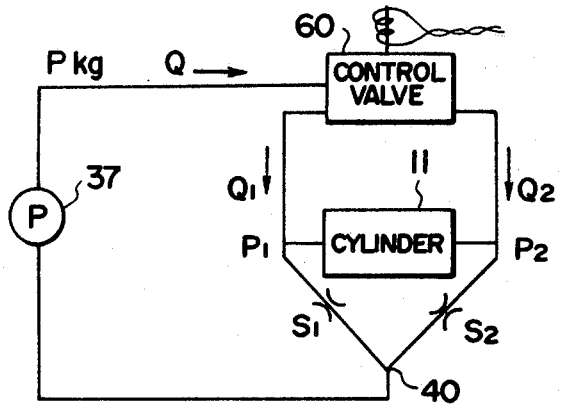
FIG. 7 is a flow chart showing the fuel flow course according to the present invention.

FIG. 7 is a flow chart of the fuel flow course according to the present invention.

A fuel flow rate Q sent out from the pump 37 is divided by the control valve 60 into the pipes 42 and 43 as flow rates $Q_1$ and $Q_2$. Fuels fed to the pressure chambers 15 and 16 are converted into pressures $P_1$ and $P_2$, and surplus fuel is sent to the discharge port 40 through the slit 17 ($S_1$) and the slit 18 ($S_2$) and finally returned to the pump 37.

In a state where the piston 14 is stationary as shown in FIG. 6, $P_1$ should necessarily equal $P_2$. In order to satisfy the above-mentioned condition, it is necessary that $Q_2/Q_1=S_2/S_1$. Namely, the piston 14 continues to move until the above-mentioned equation is established, and stops moving as soon as the condition is established.

Figure 8:
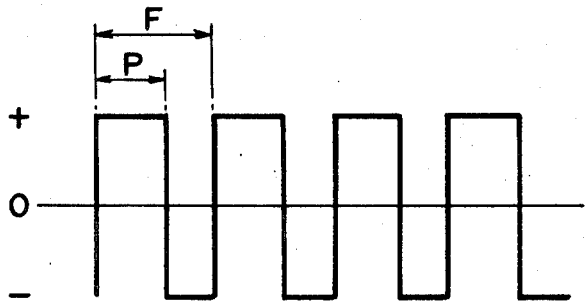
FIG. 8 is a control signal wave form diagram according to the present invention.

FIG. 8 is a wave form diagram showing the signal applied to the coil 65 of the control valve 60. The wave form has both the positive and negative polarities, and the fuel flow rate is controlled in such a manner that the ON-time P at the time of the positive polarity is changed against the constant cycle F. The ratio P/F between the cycle F and the time period P during which the positive polarity is applied with the current is the duty ratio which may be represented by:

$$P/F=Q_1/(Q_1+Q_2) \quad (1)$$

Figure 9:
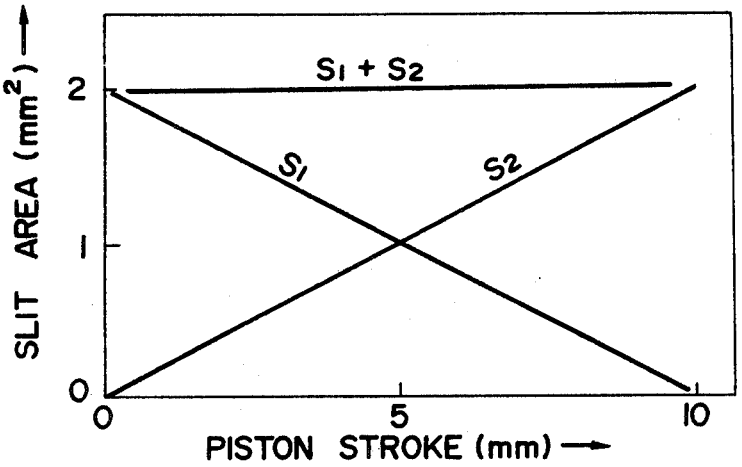
FIG. 9 is a graph depicting the change in opening area of the slits in proportion to the change in stroke of the piston according to the present invention.

On the other hand, the opening areas $S_1$ and $S_2$ of the slits 17 and 18 are varied as shown in FIG. 9. While the opening area of the slit portion on one side increases, the opening area of the slit portion on the other side decreases. In consequence, the following relations may be established, and the piston stroke, i.e., the injection time can be principally determined by varying the duty ratio of the signal fed to the control valve 60.

$$P/F=Q_1/(Q_1+Q_2)=S_1/(S_1+S_2) \quad (2)$$

Figure 10:
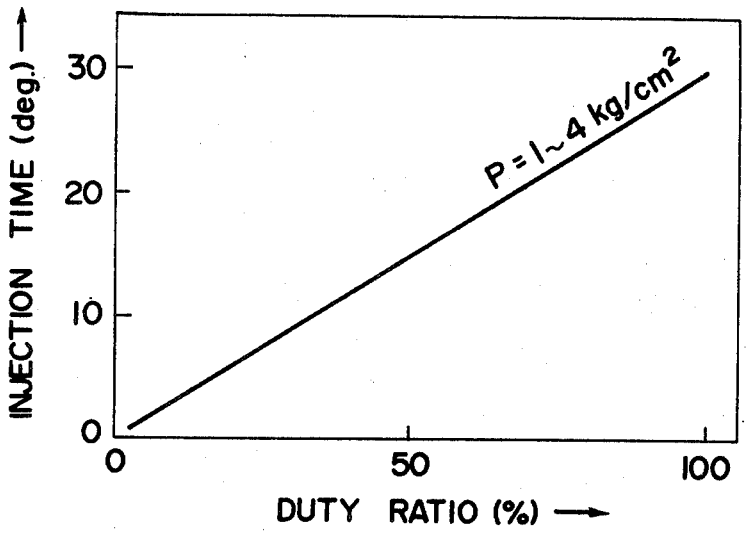
FIG. 10 is a characteristic diagram of the fuel injection time to the duty ratio according to the present invention.

The injection time (deg.) obtained by the variation of the duty ratio is shown in FIG. 10.

As described above, the roller shaft of the timer is driven by an injection time command signal having the duty ratio of the rectangular wave form, so that the injection time can be controlled without being affected by the fuel pressure.

Figure 11:
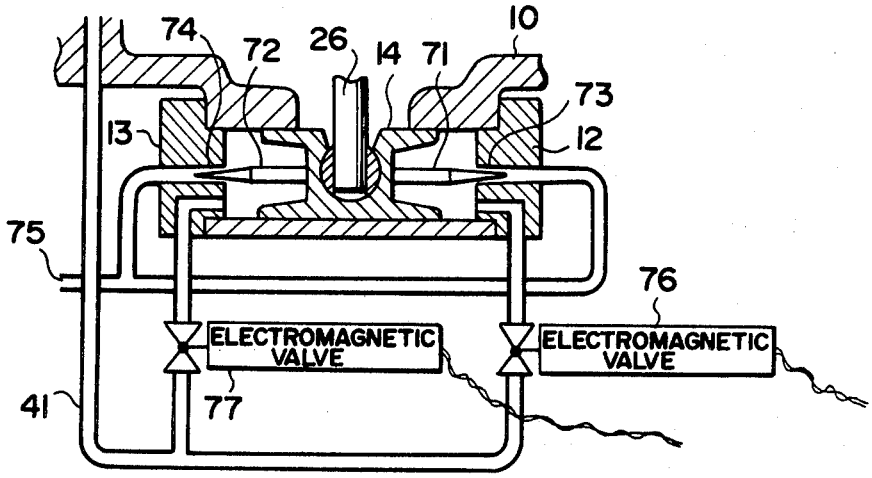
FIG. 11 is a sectional view showing another embodiment of the present invention.

FIG. 11 is a sectional view of the essential portions showing another embodiment of the present invention. In the present embodiment, in place of the slits 17 and 18 shown in the embodiment shown in FIG. 6, needles 71 and 72 operationally associated with the piston 14 are provided, and orifices 73 and 74 adapted to be coupled to the needles 71 and 72 are provided on the cylinder heads 12 and 13. The areas of the orifices 73 and 74 are made variable so as to have the same functions as the slit portions in the embodiment shown in FIG. 6. In addition, the fuel which has passed through the orifices 73 and 74 is sent to the inlet of the pump 37 through the pipe 75.

Figure 1:
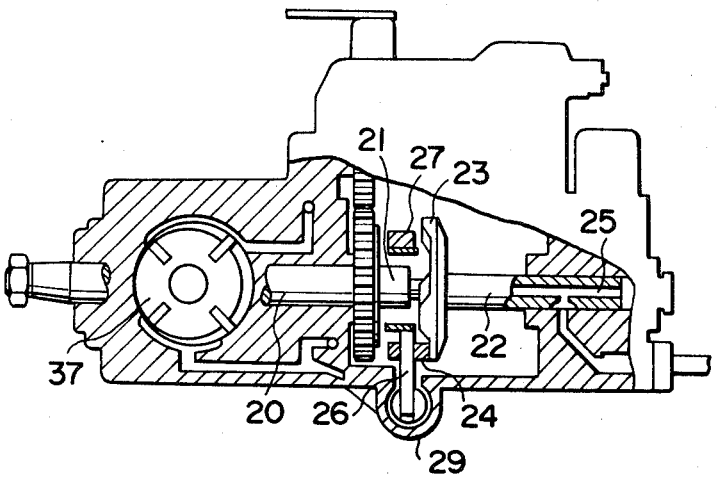
FIG. 1 PRIOR ART
FIG. 1 is a sectional view showing the conventional fuel injection time regulating mechanism in a fuel injection pump.
Figure 2:
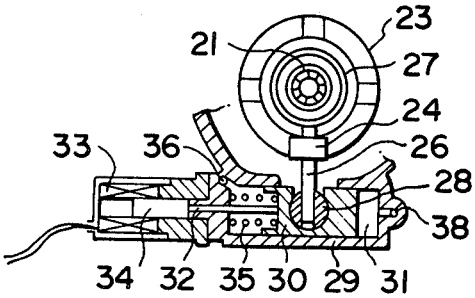
FIG. 2 PRIOR ART
FIG. 2 is a sectional view of FIG. 1 showing the conventional timing mechanism.
Figure 3:
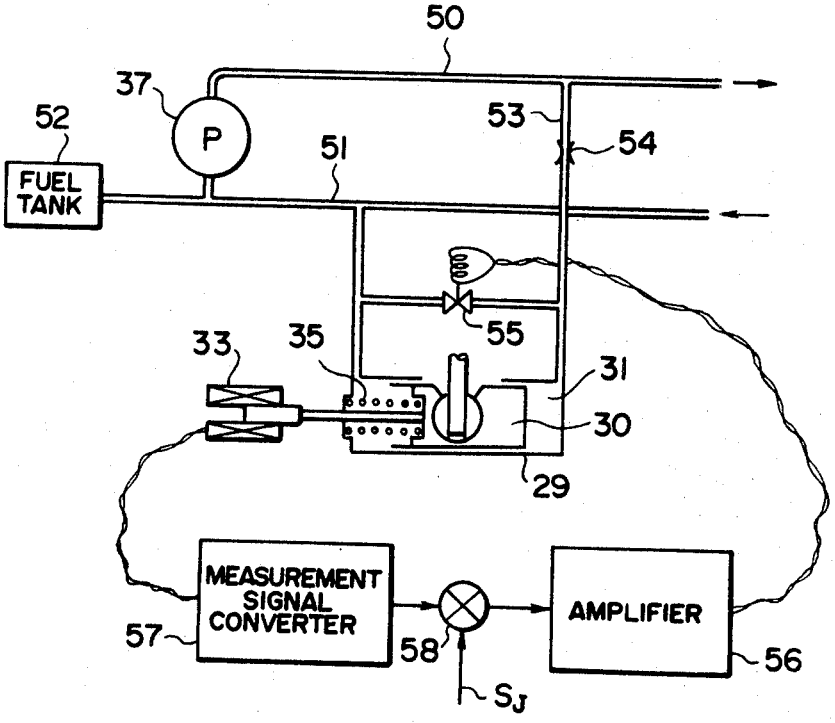
FIG. 3 PRIOR ART
FIG. 3 is a flow chart of the fuel pressure system and the electric system under the conventional fuel injection timing control.
Figure 4:
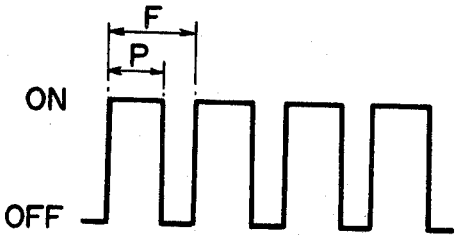
FIG. 4 PRIOR ART
FIG. 4 is a wave form diagram of the conventional solenoid valve control signal.
Figure 5:
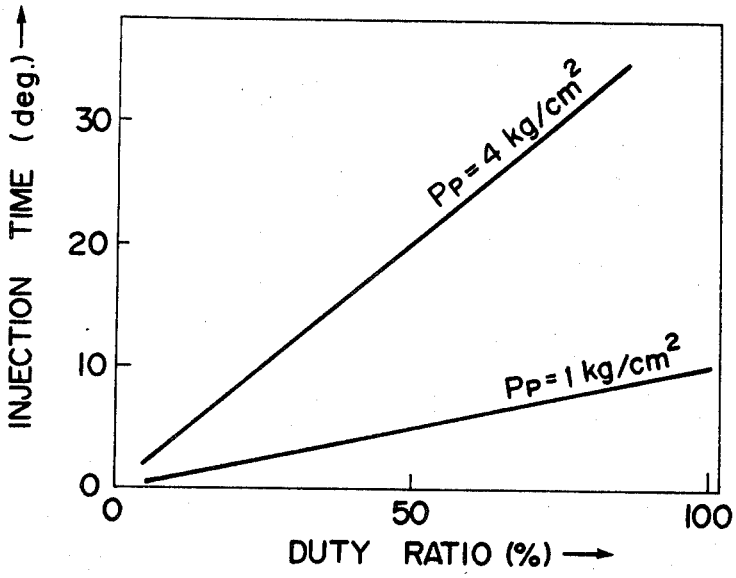
FIG. 5 PRIOR ART
FIG. 5 is a characteristic diagram showing the relation between the duty ratio and the fuel injection time.

Furthermore, in place of the control valve 60 shown in FIG. 6, solenoid valves 76 and 77 are provided, whereby such an arrangement is adopted that supplies of fuel, which have been sent out of the pipe 41, are individually fed to the pressure chambers. For example, if the solenoid valve 76 is turned "ON" by the positive polarity signal shown in FIG. 4, then the solenoid valve 77 is turned "ON" by a positive polarity signal having a wave form, into which the signal shown in FIG. 4 is inverted. In addition, other respects in the arrangement thereof are identical with those in the embodiment shown in FIG. 6, so that description thereof will be omitted.

What is claimed is:

1. In a fuel injection pump control system for a diesel engine including a timer roller shaft driven by fuel pressure from a feed pump wherein fuel injection time is automatically varied commensurate with rotational speed of said engine, the improvement comprising:

electronic control means for generating an injection time control signal having a predetermined duty ratio;

valve means responsive to said injection time control signal for selectively directing fuel from said feed pump into two branches; and a timer mechanism including a piston rotatably engaging said timer roller shaft and being slidably disposed in a cylinder, said piston defining a pair of variable pressure chambers at opposite ends of said cylinder, each said pressure chamber receiving fuel under pressure from a respective one of said branches for moving said piston in response to differential pressure between said branches and each said pressure chamber discharging fuel through a respective slit, the openings of said slits being variable in accordance with movement of said piston.

2. In a fuel injection pump control system for a diesel engine including a timer roller shaft driven by fuel pressure from a feed pump wherein fuel injection time is automatically varied commensurate with rotational speed of said engine, the improvement comprising:

electronic control means for generating an injection time control signal having a predetermined duty ratio;

valve means responsive to said injection time control signal for selectively directing fuel from said feed pump into two branches; and a timer mechanism including a piston rotatably engaging said timer roller shaft and being slidably disposed in a cylinder, said piston defining a pair of variable pressure chambers at opposite ends of said cylinder, each said pressure chamber receiving fuel under pressure from a respective one of said branches for moving said piston in response to differential pressure between said branches, said piston including needles secured to and axially extending from the opposite ends thereof, said needles cooperating with respective ports in said pressure chambers for discharging fuel in said pressure chambers.

3. A fuel injection pump control system as set forth in claim 1, wherein said valve means comprises an armature energized in response to said injection time control signal and a control valve including a pair of flapper valves adapted to close one of said branches thereof when said armature is abutted thereagainst.

4. A fuel injection pump control system as set forth in claim 2, wherein said valve means comprises two solenoid valves alternately energized in response to said injection time control signal.

* * * * *